US011246355B1

(12) United States Patent
Williamson

(10) Patent No.: US 11,246,355 B1
(45) Date of Patent: Feb. 15, 2022

(54) ATHLETIC GARMENT WITH DUAL-POSITION PANEL AND CONCEALABLE DECORATION LAYER

(71) Applicant: Amy Williamson, Lake Ronkonkoma, NY (US)

(72) Inventor: Amy Williamson, Lake Ronkonkoma, NY (US)

( * ) Notice: Subject to any disclaimer, the term of this patent is extended or adjusted under 35 U.S.C. 154(b) by 267 days.

(21) Appl. No.: 16/443,379

(22) Filed: Jun. 17, 2019

(51) Int. Cl.

| | |
|---|---|
| ***A41D 1/14*** | (2006.01) |
| ***A41D 27/08*** | (2006.01) |
| ***A41D 1/22*** | (2018.01) |
| ***A41D 27/20*** | (2006.01) |

(52) U.S. Cl.
CPC ..... *A41D 1/22* (2013.01); *A41D 1/14* (2013.01); *A41D 27/08* (2013.01); *A41D 27/201* (2013.01); *A41D 2300/22* (2013.01); *A41D 2300/322* (2013.01); *A41D 2300/324* (2013.01); *A41D 2600/10* (2013.01)

(58) Field of Classification Search
CPC ..... A41D 1/22; A41D 1/14; A41D 2300/22; A41D 15/00; A41D 15/02; A41D 27/08; A41D 27/201; A41D 2600/10
USPC ..... 2/71
See application file for complete search history.

(56) References Cited

U.S. PATENT DOCUMENTS 1,076,124 A * 10/1913 Juda ..... A41D 1/14 2/211
1,091,827 A * 3/1914 Galluzzo ..... A41D 1/14 2/212
1,104,632 A * 7/1914 Cowen ..... A41D 1/086 2/212
1,139,881 A * 5/1915 Malsin ..... A41D 1/14 2/211
2,498,184 A * 2/1950 Sever ..... A41D 15/02 2/213
2,513,108 A * 6/1950 Reger ..... A41D 1/14 2/212
2,580,774 A * 1/1952 Helbig ..... A41D 1/06 2/212
2,697,224 A * 12/1954 Aidenland ..... A41B 9/08 2/71
2,758,312 A * 8/1956 Goldstein ..... A41D 1/14 2/212
2,799,022 A * 7/1957 Parise ..... A41D 1/21 2/76
2,825,905 A * 3/1958 Merl ..... A41D 15/00 2/211

(Continued)

*Primary Examiner* — Alissa L Hoey
(74) *Attorney, Agent, or Firm* — Betsy Kingsbury Dowd; BKDowd Law, P.C.

(57) ABSTRACT

An athletic garment includes a body-fitting portion and a skirt draped over the body-fitting portion. The skirt includes an attached portion fixedly attached to the body-fitting portion, and a dual-position panel forming a detachably connected portion of the skirt. The dual-position panel is repositionable by a wearer between a first position and a second position. The garment also includes a concealable decoration layer fixedly attached to the body-fitting portion, such that the dual-position panel detachably connected in the first position overlays and substantially conceals the concealable decoration layer. The concealable decoration layer overlays at least a portion of the dual-position panel in the second position.

19 Claims, 8 Drawing Sheets

(56) References Cited

U.S. PATENT DOCUMENTS 2,827,638 A * 3/1958 Scharf ..... A41D 1/14 2/212
2,890,460 A * 6/1959 Levi ..... A41D 15/005 2/144
3,110,903 A * 11/1963 Burchard ..... A41D 1/08 2/221
3,218,651 A * 11/1965 Yesayan ..... A41D 15/00 2/211
3,399,679 A * 9/1968 Barg ..... A41B 9/08 450/95
3,574,237 A * 4/1971 Reynolds ..... A41D 1/14 2/211
3,859,667 A * 1/1975 Roy ..... A41D 1/14 2/212
3,975,777 A * 8/1976 Roy ..... A41D 1/06 2/211
4,079,871 A * 3/1978 Sica ..... A45C 11/00 224/677
4,433,803 A * 2/1984 Liberboim ..... A63B 47/001 224/251
4,453,274 A * 6/1984 Allen ..... A41D 15/005 2/102
4,686,714 A * 8/1987 Harley ..... A41D 15/005 2/105
4,907,298 A * 3/1990 Lisowski ..... A41D 15/02 2/212
5,052,058 A * 10/1991 Mueller ..... D04B 21/20 2/228
5,136,726 A * 8/1992 Kellin ..... A41D 27/08 2/115
5,159,718 A * 11/1992 Moyer ..... A41D 13/01 2/102
5,588,154 A * 12/1996 Blauer ..... A41D 1/06 2/115
5,771,494 A * 6/1998 Ralston ..... A41D 1/14 2/211
5,802,619 A * 9/1998 Ralston ..... A41F 9/02 2/220
6,148,443 A * 11/2000 Maastricht ..... A63B 57/0032 2/69
6,286,152 B1 * 9/2001 Mooneyhan ..... A41F 9/025 2/237
6,769,139 B1 * 8/2004 Goldkind ..... A41D 11/00 2/227
7,353,545 B1 * 4/2008 Blauer ..... A41D 13/01 2/115
7,441,281 B2 * 10/2008 Salem ..... A41D 15/005 2/115
7,814,574 B2 * 10/2010 Gheneva ..... A41D 1/06 2/227
8,272,072 B1 * 9/2012 Fowler ..... A41D 15/00 2/265
8,856,970 B2 * 10/2014 French ..... F41C 33/048 2/251
9,986,773 B2 * 6/2018 Kroecher ..... A41D 1/06
10,244,803 B2 * 4/2019 Powell ..... A41D 27/202
10,555,572 B2 * 2/2020 Diakonov ..... A41D 1/08
10,674,777 B2 * 6/2020 Fisher ..... A41D 27/204
10,834,983 B2 * 11/2020 Cherry ..... A41D 27/20
2006/0010570 A1 * 1/2006 Villegas ..... A41D 1/14 2/211
2007/0101481 A1 * 5/2007 Stokesbary ..... A41D 7/005 2/211
2007/0157367 A1 * 7/2007 Kerkhoff ..... A41D 1/06 2/227
2007/0214546 A1 * 9/2007 Roeger, III ..... A41D 1/14 2/211
2009/0300818 A1 * 12/2009 Waite ..... A41F 9/00 2/76
2010/0170026 A1 * 7/2010 Jeffords ..... A41D 27/08 2/227
2010/0281595 A1 * 11/2010 Gernes ..... A41B 9/001 2/69
2012/0047630 A1 * 3/2012 Gare ..... A41D 27/08 2/244
2012/0090076 A1 * 4/2012 Kenney ..... A41D 15/02 2/212
2013/0305433 A1 * 11/2013 Hedrick ..... A41D 31/185 2/220
2014/0182044 A1 * 7/2014 Cole ..... A41D 27/208 2/69
2016/0331053 A1 * 11/2016 Gordon ..... A41D 7/00
2017/0035123 A1 * 2/2017 Rodd ..... A41D 1/084
2017/0354192 A1 * 12/2017 Albano ..... A41D 1/089
2020/0229516 A1 * 7/2020 Curran ..... A41D 27/20

* cited by examiner

ATHLETIC GARMENT WITH DUAL-POSITION PANEL AND CONCEALABLE DECORATION LAYER

FIELD OF THE DISCLOSURE

The present invention relates generally to women's sports garments and more specifically to an athletic skirt with dual functionality.

BACKGROUND

One option for women's athletic wear is the athletic skirt, which has the appearance of a skirt but also typically includes built-in fitted shorts or panties as an underlayer. Athletic skirts are known for use, for example, in the sports of running, tennis, and field hockey, but of course can be used for any sport.

The sport of running is one example of a sport that offers highly competitive events for qualified participants, but which also provides opportunities to amateur runners at all levels to participate in running various distances in charitable events to raise money and promote social awareness of worthwhile causes. Various world-wide events are held annually for cancer research, for example. Participants in each of these events can easily number in the hundreds. Often, a group of runners from the same running club or sponsored by a particular corporation will don similar colors or special t-shirt representative of their group as a way of promoting their group.

Running is also a highly social sport, with runners (or joggers) often meeting in small groups for a daily run. Regardless of whether a woman is going for a "social" run or participating in an official event, a running skirt can be an appealing choice for both its aesthetics and functionality. However, there are no known running skirts that have built-in features for accessorizing the skirt to one's individual liking and/or for indicating membership in a group or participation in an event, or for converting between a sleek, more functional, skirt for running and an accessorized skirt suitable for after a run, or even for use as casual wear.

Accordingly, there is a need for a women's athletic garment that can convert between a more functional sports garment and a custom-accessorized skirt for casual wear.

SUMMARY

Features of the disclosure will become apparent from the following detailed description considered in conjunction with the accompanying drawings. It is to be understood, however, that the drawings are designed as an illustration only and not as a definition of the limits of this disclosure.

The present disclosure is directed to a women's athletic garment including a skirt that can convert between a more functional sports garment and a custom-accessorized skirt for casual wear.

The present disclosure is also directed to an athletic garment including a skirt, a dual-position panel, and a concealable decoration layer configured to allow a user to customize the same athletic skirt with different accessories to provide a customized aesthetic appearance when used for casual wear, and to remove the accessories and reposition the dual-position panel for a sleek functional appearance when desired.

The present disclosure is further directed to an athletic garment including a body-fitting portion, a skirt draped over the body-fitting portion, and a concealable decoration layer.

The skirt includes an attached portion fixedly attached to the body-fitting portion, and a dual-position panel forming a detachably connected portion of the skirt.

The dual-position panel is repositionable by a wearer between a first position and a second position. The concealable decoration layer is fixedly attached to the body-fitting portion, such that the dual-position panel detachably connected in the first position overlays and substantially conceals the concealable decoration layer. With the dual-position panel detachably connected in the second position, the concealable decoration layer overlays at least a portion of the dual-position panel.

Embodiments of the athletic garment can include one or more of the following features and/or aspects of other aspects.

In embodiments, the dual-position panel extends from a first end portion of the attached portion, and the concealable decoration layer is fixedly attached to the body-fitting portion between a second end portion of the attached portion of the skirt and the first end portion.

In further embodiments, the dual-position panel may be detachably connected in the first position to the second end portion, to the concealable decoration layer, and/or to a connecting portion therebetween, which may, in embodiments, be a seam joining the second end portion to the concealable decoration layer.

In additional embodiments, the dual-position panel may be detachably connected in the second position to the body-fitting portion.

Aspects of the dual-position panel may include an inner layer, the dual-position panel, in embodiments, including a connecting element fixedly attached thereto. The connecting element, in aspects, may be positioned along an upper portion of a vertical edge portion of the dual-position panel.

The second end portion, the concealable decoration layer, and/or the connecting portion may include a paired connecting element, the dual-position panel being detachably connected in the first position to the one of the second end portion and the concealable decoration layer via the connecting element and the paired connecting element.

In additional aspects, the body-fitting portion may include a paired connecting element, the dual-position panel being detachably connected in the second position to the body-fitting portion via the connecting element and the paired connecting element.

In additional embodiments of the athletic garment, the concealable decoration layer includes at least one attaching element fixed on the concealable decoration layer for removably attaching at least one decorative item thereto.

Still additional embodiments may further include the at least one decorative item removably attached via the at least one attaching element to the concealable decorative layer in the second position.

In aspects, the concealable decoration layer may have an unattached arcuate edge.

In embodiments of the athletic garment, the second end portion, the concealable decoration layer, and/or the connecting portion includes a first paired connecting element, and the body-fitting portion includes a second paired connecting element. The dual-position panel is detachably connected in the first position to the second end portion, the concealable decoration layer, or to the connecting portion via the connecting element and the first paired connecting element. The dual-position panel is repositionable and detachably connected in the second position to the body-fitting portion via the connecting element and the second paired connecting element.

In aspects, the connecting element is one portion of a snap device and each of the first paired connecting element and the second paired element is a second portion of the snap device.

In embodiments of the athletic garment, the body-fitting portion includes one of shorts and panties.

In embodiments, the athletic garment may include at least one back pocket.

Embodiments of the athletic garment may also include a vertical slit in the skirt. In aspects, a vertical edge portion of the dual-position panel in the first position forms a first side of the vertical slit, and a vertical edge of the second end portion forms a second side of the vertical slit.

Embodiments may also include a vertical slit in the second position, which may be formed, in aspects, between each of a portion of a vertical edge of the second end portion and a vertical edge portion of the dual-position panel that extends vertically below the concealable decoration layer.

In additional embodiments, a vertical edge of the second end portion coincides with a side seam of the skirt, the side seam fixedly attaching the second end portion to the concealable decoration layer.

Embodiments of the athletic garment may further include a waistband. In aspects, an upper edge portion of the attached portion and of the concealable decoration layer may be fixedly attached to both the body-fitting portion and to the waistband.

In embodiments, the athletic garment may include a zippered pocket in one of a front and rear of the waistband, and at least one elasticized holder including a vertically aligned elasticized loop attached at its ends to the waistband.

In aspects, an upper edge of the dual-position panel may extend across about 15% to about 40% of a width of the waistband and, in other aspects, may extend across about 25% of a width of the waistband.

In addition to the above embodiments and aspects of the present invention, additional aspects, objects, features and advantages will be apparent from the embodiments presented in the following description and in connection with the accompanying drawings.

BRIEF DESCRIPTION OF THE DRAWINGS

The drawings constitute a part of this disclosure and include examples, which may be implemented in various forms. It is to be understood that in some instances, various aspects of the disclosure may be shown exaggerated or enlarged to facilitate understanding. The teaching of the disclosure can be readily understood by considering the following detailed description in conjunction with the accompanying drawings.

Figure 1A:
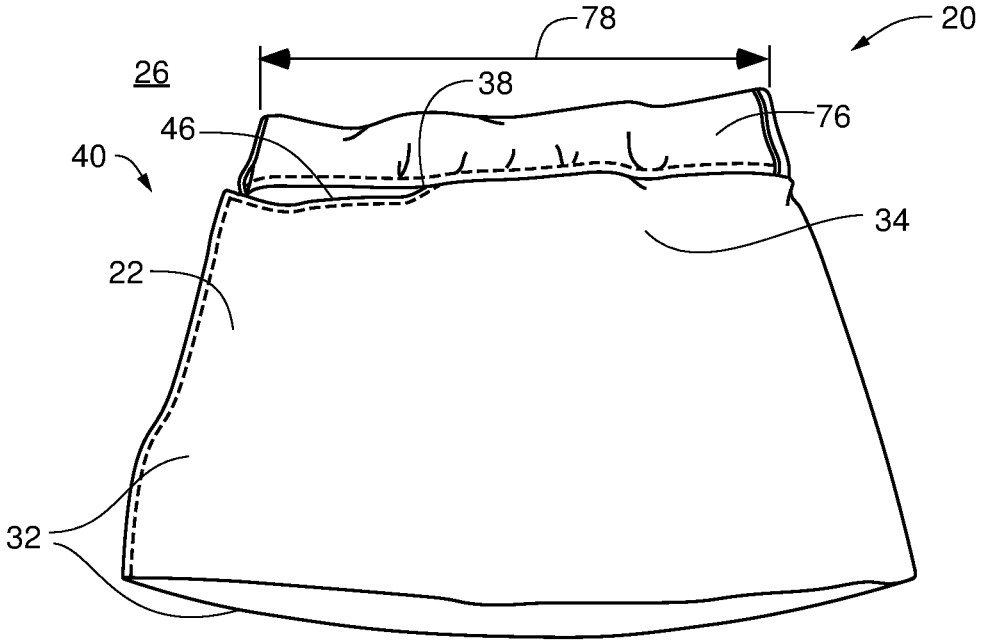
FIG. 1A is a pictorial representation of a front view of an embodiment of an athletic garment of the present disclosure with a dual-position panel detachably connected in a first position for a sleek appearance and optimum functionality.

The various aspects of the present disclosure mentioned above are described in further detail with reference to the aforementioned figures and the following detailed description of exemplary embodiments.

DETAILED DESCRIPTION

The following sections describe exemplary embodiments of the present invention. It should be apparent to those skilled in the art that the described embodiments of the present invention provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present invention as defined herein and equivalents thereto.

Particular illustrative embodiments of the present disclosure are described hereinbelow with reference to the accompanying drawings; however, the disclosed embodiments are merely examples of the disclosure, which may be embodied in various forms. It should be apparent to those skilled in the art that the described embodiments provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present disclosure of a modular shower pan as defined herein and equivalents thereto. Well-known functions or constructions and repetitive matter are not described in detail to avoid obscuring the present disclosure in unnecessary or redundant detail. Therefore, specific structural and functional details disclosed herein are not to be interpreted as limiting. In this description, as well as in the drawings, like-referenced numbers represent elements which may perform the same, similar, or equivalent functions.

Throughout the description, where items are described as having, including, or comprising one or more specific components or features, or where methods are described as having, including, or comprising one or more specific steps, it is contemplated that, additionally, there are items of the present disclosure that consist essentially of, or consist of, the one or more recited components or features, and that there are methods according to the present disclosure that consist essentially of, or consist of, the one or more recited processing steps.

The present disclosure is directed generally to an athletic garment including a skirt and body-fitting portion, which is convertible between a sleek, functional athletic skirt and a custom-accessorized skirt. When converted to the custom-accessorized skirt, custom accessories, also referred to herein as decorative items, may be removably attached when desired. Such decorative items may be added to the garment for casual wear, and may be purely decorative and reflective of one's individual style preferences. The wearer may also add decorative items for casual wear, or after participation in an event, that demonstrate sponsorship, participation in the athletic event, and/or membership in a particular group, such as an athletic club.

Figure 5A:
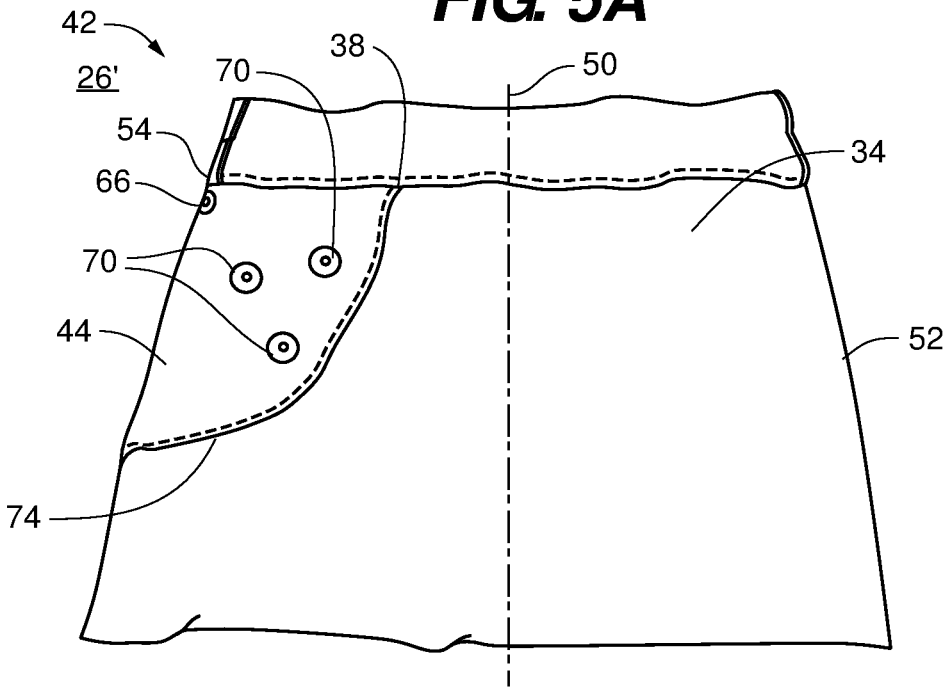
FIG. 5A is a front view of the athletic garment of FIG. 1A for use with the dual-position panel connected as shown in FIG. 4 in the second position, exposing the concealable decoration layer.
Figure 5B:
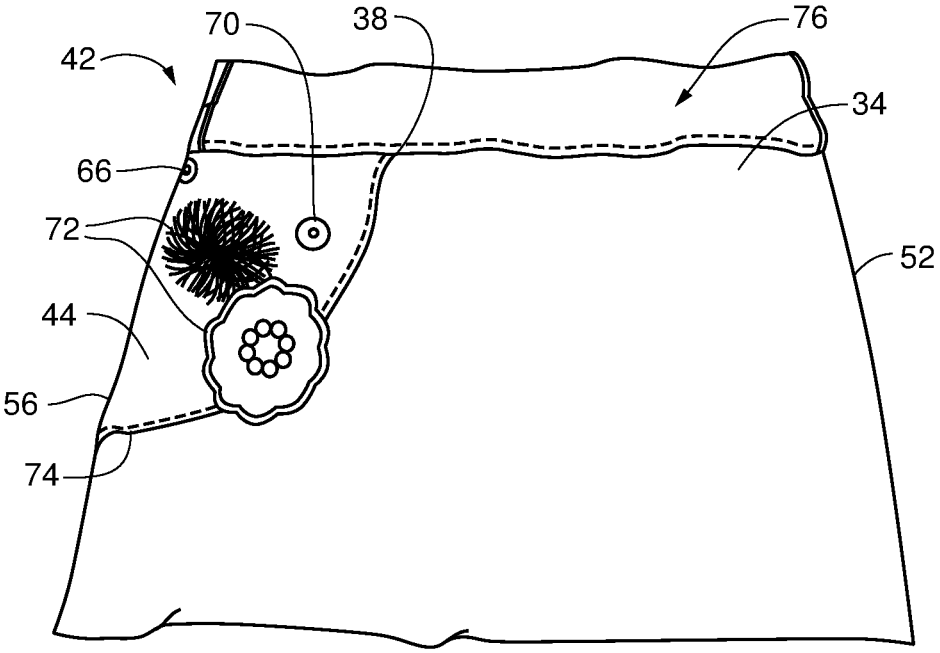
FIG. 5B is a front view of an embodiment of the athletic garment as shown in FIG. 5A with a few decorations attached.

Referring to FIGS. 1A, 1B, 2, and 5B, for example, an embodiment of the athletic garment 20 of the disclosure includes a repositionable, dual-position panel 22 which forms a detachably connected portion of the athletic garment 20 that allows conversion from a sleek, functional skirt as shown in FIG. 1A to a custom-accessorized skirt as shown in FIGS. 5A and 5B, without removal of the dual-position panel 22 from the athletic garment 20.

The athletic garment of the disclosure also includes fixedly attached portions. As used herein, one portion or item being "fixedly attached" to another portion or item means fixed in place relative to the other item for forming the athletic garment, and not intended to be either moved or removed. The "fixedly attached" portions or items of the athletic garment described herein do not necessarily physically touch each other. For example, as known in the garment industry, there could be a liner or layer or another portion of the garment also fixed between the two portions which are fixedly attached to one another, particularly if they are fixedly attached by sewing. Other examples of fixedly attached include, but are not limited to, heat-sealed together, glued together by adhesives, or the fixedly attached portions may be integral to one another, i.e., made from one and the same piece of fabric.

Figure 1B:
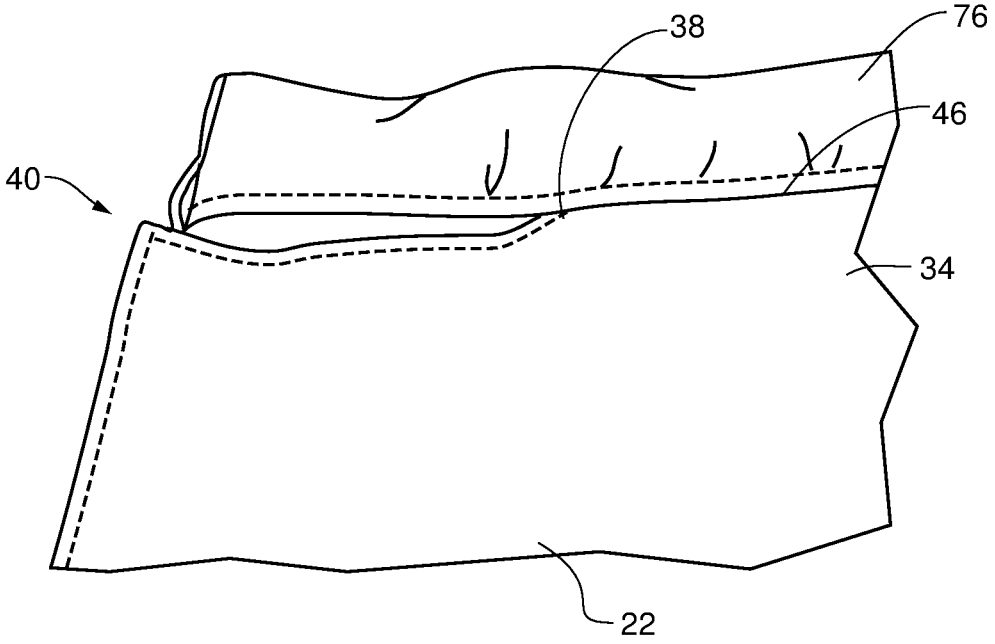
FIG. 1B is a magnified view of the detachable connection of the dual-position panel in the first position to the skirt of the athletic garment of FIG. 1A, via a detachable connecting element.
Figure 2:
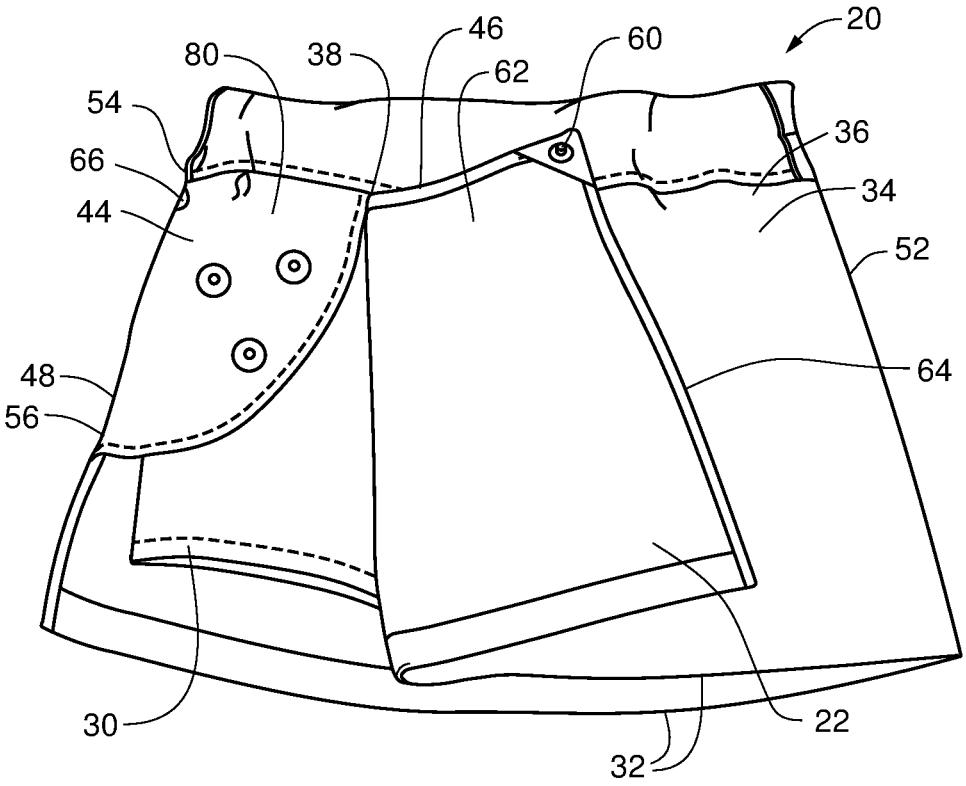
FIG. 2 is a front view of the athletic garment of FIG. 1A prior to detachably connecting the dual-position panel for use, showing a detachable connecting element on an inside layer of the dual-position panel.
Figure 3:
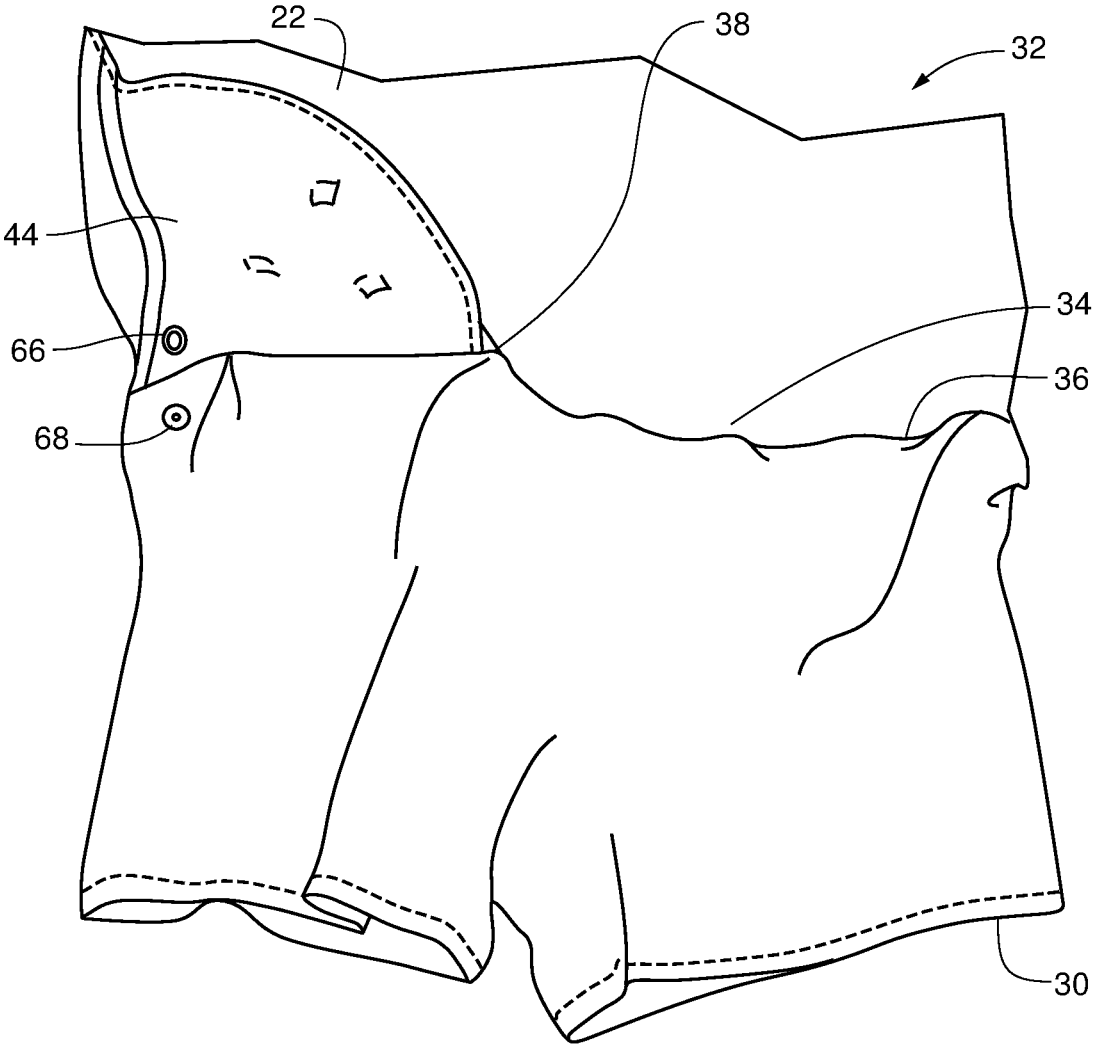
FIG. 3 is a front view of an embodiment of a body-fitting portion showing a second connecting element attached thereto for detachably connecting the dual-position panel of FIG. 1A in a second position for exposing the concealable decoration layer.
Figure 8:
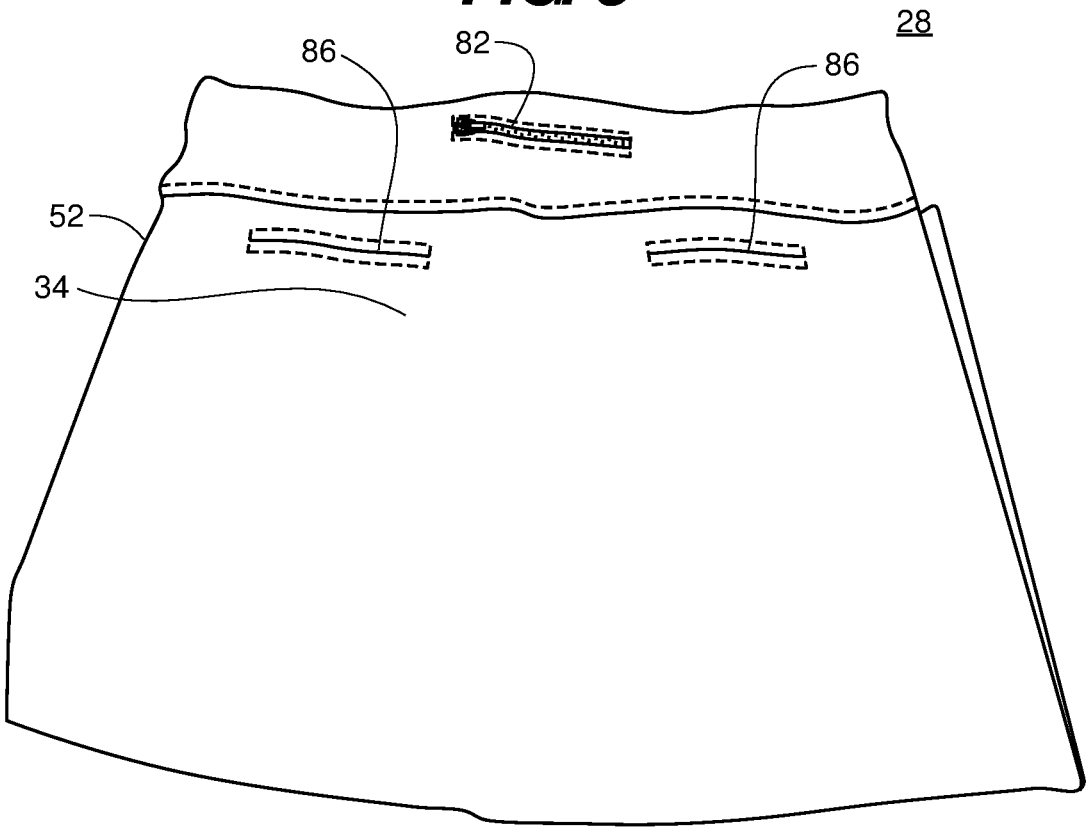
FIG. 8 is a rear view of an embodiment of the athletic garment of FIG. 1A.

As best shown in FIGS. 2 and 3, embodiments of the athletic garment 20 include a body-fitting portion 30 and a skirt 32 draped over the body-fitting portion 30. In various embodiments, the body-fitting portion 30 may be shorts or panties, which may be body-hugging or loose. A portion of the skirt 32, referred to as an attached portion 34, may be fixedly attached, for example, along an upper edge portion 36 of the skirt 32, to the body-fitting portion 30. In embodiments, as best shown, for example, in FIGS. 1A-3 and FIG. 8, the fixedly attached portion 34 of the skirt 32 may include a portion of a front side 26 of the athletic garment 20 as well as an entire rear side 28 of the athletic garment (FIG. 8).

The athletic garment 20 also includes a detachably connected portion of the skirt 32 referred to as the dual-position panel 22. As best shown in FIGS. 1B and 2, in embodiments, an upper edge portion 46 of the dual-position panel 22 extends from, and is fixedly and preferably integrally attached at a first end portion 38 to the attached portion 34 of the skirt 32. The dual-position panel 22 is repositionable, without removal from the garment 20, between a first position 40, to form a sleek, functional skirt, as shown, for example in FIG. 1A, and a second position 42 (see FIG. 5A, e.g.) to form a customizable decorative skirt, as shown, for example, in FIG. 5B.

Referring to FIGS. 2, 5A and 5B, for example, the athletic garment 20 also includes a concealable decoration layer 44, which is concealed when the dual-position panel 22 is attached in the first position 40 and visible and customizable when the dual-position panel 22 is attached in the second position 42.

Figure 4:
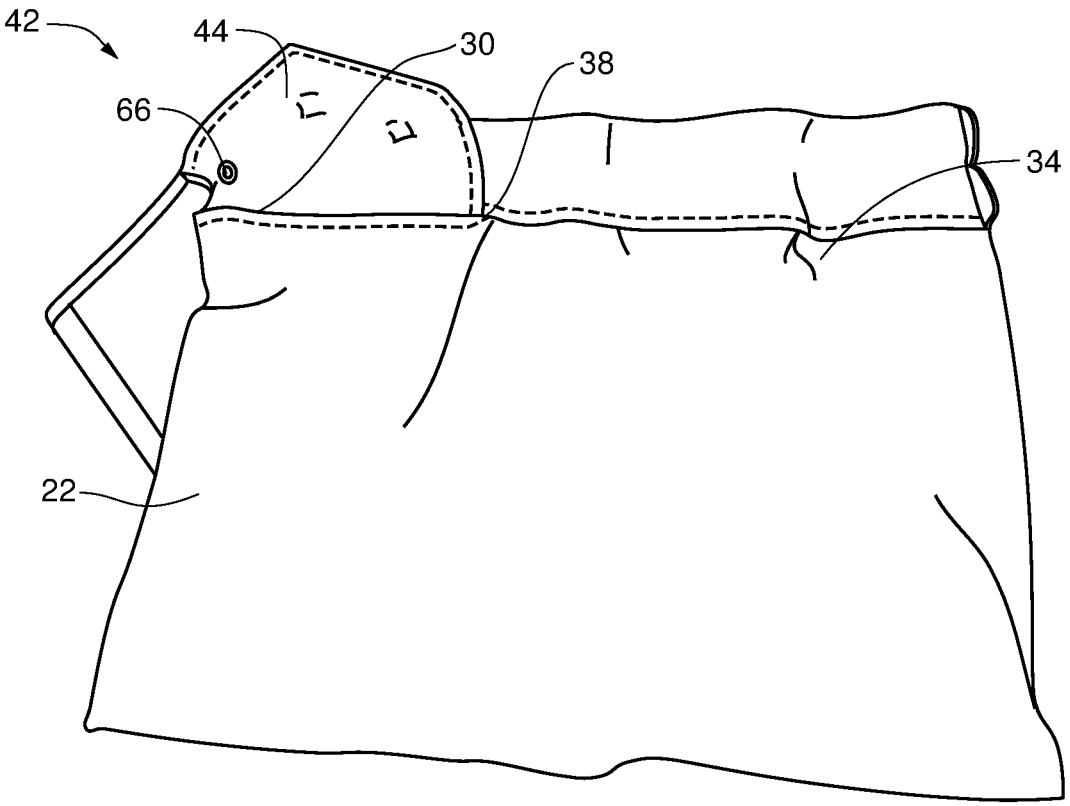
FIG. 4 is a front view of the dual-position panel connected via the second connecting element in the second position; the concealable decoration layer is folded up to show the dual-position panel detachably connected to the body-fitting portion of FIG. 3 in the second position.

As best shown in FIGS. 2-4, in embodiments, the customizable decorative layer 44 is fixedly attached to the athletic garment 20, and in further embodiments, to the body-fitting portion 30, between the first end portion 38 of the attached portion 34 of the skirt 32 and a second end portion 49 of the attached portion 34 of the skirt 32.

Figure 6A:
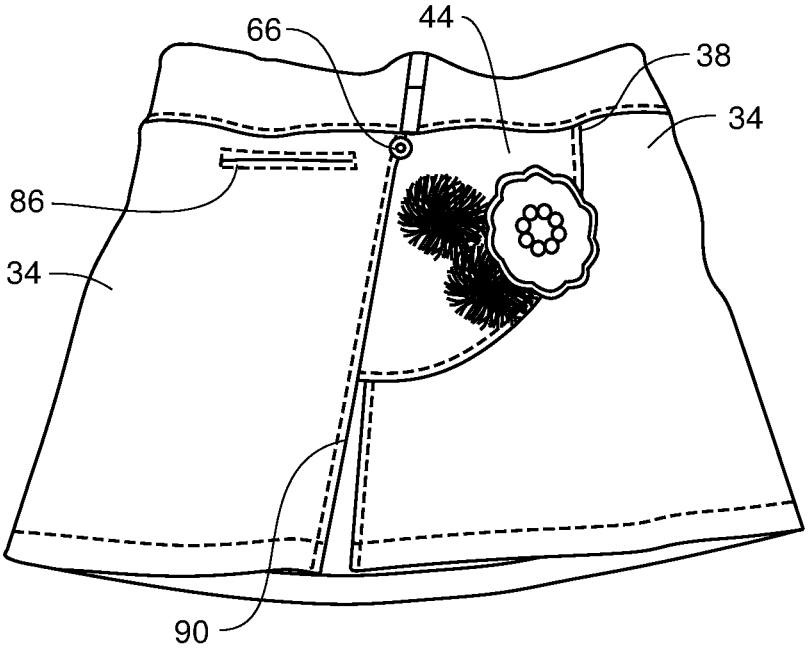
FIG. 6A is a left side view of an embodiment of the athletic garment of FIG. 1A with the dual-position panel connected in the second position, with a few decorations attached.
Figure 6B:
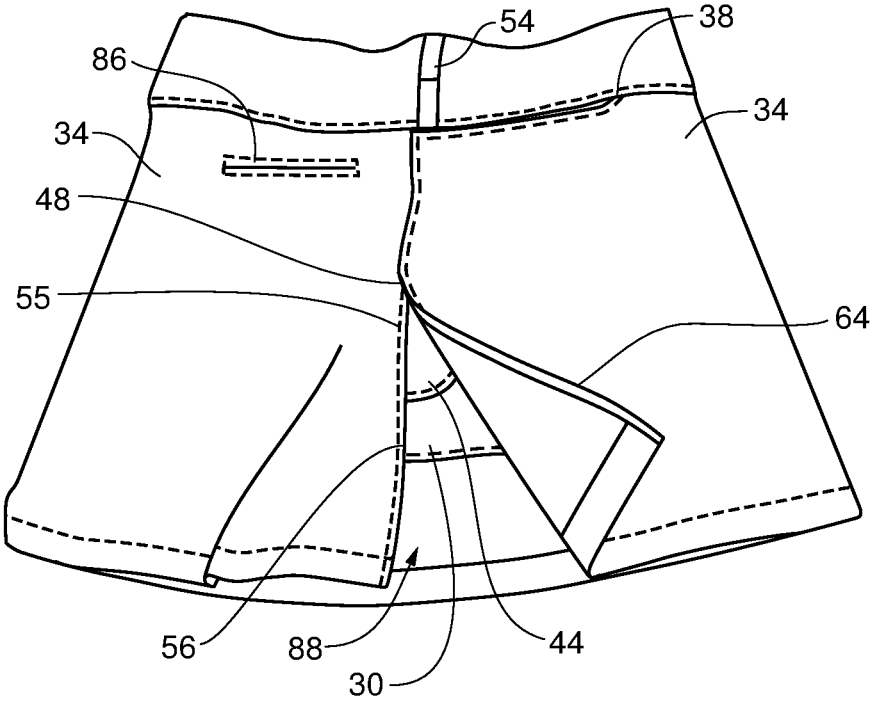
FIG. 6B is a left side view of an embodiment of the athletic garment of FIG. 1A with the dual-position panel connected in the first position.

In the embodiments shown, referring to FIG. 5A, for example, the first end portion 38 is located on the front side 26 of the garment and toward a left side of a longitudinal center line 50 of the garment 20. Referring also to FIG. 6B, the attached portion 34 of the skirt 32 wraps around a right side 52 of the athletic garment 20, across the rear side 28 (FIG. 8) to the second end portion 48 defined by a seam 55 at a left side 54. As best shown in FIGS. 5A, 5B, and 6B, an upper portion of a vertical edge 56 of the skirt 32 overlapping a vertical edge of the concealable decoration layer 44 may be fixedly attached thereto via a connecting portion 55, e.g., a seam, connecting the concealable decoration layer 44 to the attached portion 34 of the skirt 32 at the second end portion 48.

Referring to FIG. 2, the dual-position panel 22 preferably includes a connecting element 60 fixedly attached to an inner layer 62, which allows a vertical edge portion 64 of the dual-position panel 22 to be detachably connected to the garment 20 at the location of the connecting element 60. In embodiments, the connecting element 60 is positioned along an upper portion of the vertical edge portion 64 of the dual-position panel.

A first paired connecting element 66 is fixedly attached, in embodiments, on the concealed decoration layer 44, which is configured to engage with, and easily detachably connect to and disconnect from, the connecting element 60. The connecting side of the first paired connecting element 66 is visible in FIGS. 2, 5A and 5B, with the back side (does not operate to connect) of 66 as sewn into the garment 20 also visible in FIGS. 3 and 4.

Referring to FIGS. 1A-2, the dual-position panel 22 is detachably connected in the first position 40 to the concealable decoration layer 44 by engaging and connecting the connecting element 60 to the paired connecting element 66. When attached in this manner, the athletic garment 20 has the sleek functional appearance shown in FIG. 1A, with the dual-position panel 22 overlaying and concealing at least a portion of the concealable decoration layer 44.

In embodiments, as shown in FIG. 1A, the dual-position panel 22 overlays and substantially conceals, for example, conceals at least 90% of the area of, the concealable decoration layer 44 in the first position 40.

In embodiments, first paired connecting element 66 may be fixedly attached to the second end portion 48, the concealable decoration layer 44 or to the connecting portion 55 and is connected via the connecting element 60 on the dual-position panel 22 in the first position 40.

Referring to FIG. 3, the athletic garment 20 also includes a second paired connecting element 68, in embodiments, which is fixed to the body-fitting portion 30. Referring also to FIGS. 2 and 4, in embodiments, the dual-position panel 22 is detachably connected to the body-fitting portion 30 in the second position 42, via the connecting element 60 and the second paired connecting element 68.

Referring to FIGS. 5A and 5B, the second paired connecting element 68 is preferably positioned such that the concealable decoration layer 44 overlays at least a portion of the dual-position panel 22 when attached in the second position. In embodiments, the concealable decoration layer 44 overlays and conceals at least the upper edge portion 46 of the dual-position panel 22 attached in the second position.

The athletic garment 20 of the invention preferably uses easily connectable and disconnectable pairs of elements 60/66, and 60/68, conveniently positioned such that the dual-position panel 22, which is not removable from the garment 20, is repositionable between the first 40 and second position 42 while still being worn by a wearer.

In embodiments, the connecting element 60 is one portion of a snap device each of the paired connecting element 66, 68 is a second portion of the snap device, and are snapped together for connecting or attaching the dual position panel 22 to the first 40 or the second position 42 and unsnapped for detaching and repositioning the dual-position panel 22.

Any other suitable pairs of connecting element and paired connecting element may also be used, for example, hook and loop type attaching elements.

As shown in FIG. 3, in which the skirt 32 has been fully lifted to reveal the front of the body-fitting portion 30, the first paired connecting element 66 is aligned to overlap, and may contact, the second paired connecting element 68 when the garment 20 is configured for wearing, as in FIG. 2, for example. With the connecting elements 66, 68 co-aligned in this way, the dual-position panel 22 will lay flat over the concealable decoration layer 44 when attached in the first position 40 and under the concealable decoration layer 44 in the second position 42.

Referring to FIGS. 5A and 5B, with the dual-position panel 22 fixed in the second position 42, the concealable decoration layer 44 is revealed. In embodiments, the concealable decoration layer 44 may have integrated design elements, such as, but not limited to, embroidered designs.

In additional embodiments, the concealable decoration layer 44 may include at least one attaching element 70 fixed thereon, for removably attaching at least one decorative item 72 thereto.

Embodiments of the athletic garment 20 may further include the at least one decorative item 72 removably attached via the at least one attaching element 70 to the concealable decorative layer 44 as shown in FIG. 5B, with the dual-position panel 22 attached in the second position 42.

The attaching elements 70, in embodiments, may be snaps, which may be fabric covered snaps as shown.

In other embodiments, the attaching elements 70 may be the hook and loop type.

Another feature of the concealable decoration panel 44 that has aesthetic appeal is the shape of unattached edge 74, which may be arcuate or curved, for example, as shown.

Referring again to FIG. 1A, in embodiments, the athletic garment 20 further includes a waistband 76, which may be elasticized for a comfortable fit, and which is characterized by a width 78 when laid flat as shown.

In embodiments, the upper edge 46 of the dual-position panel 22 extends across about 15% to about 40% of the width 78 of the waistband 76.

In additional embodiments, the upper edge 46 of the dual-position panel 22 extends across about 25% of the width 78 of the waistband 76.

Referring, for example, to FIG. 2, in further embodiments, the upper edge 36 of the attached portion 34 of the skirt 32 and preferably, an upper edge 80 of the concealable decoration layer 44 are fixedly attached, e.g., by sewing, to both the body-fitting portion 30 and to the waistband 76.

Figure 7:
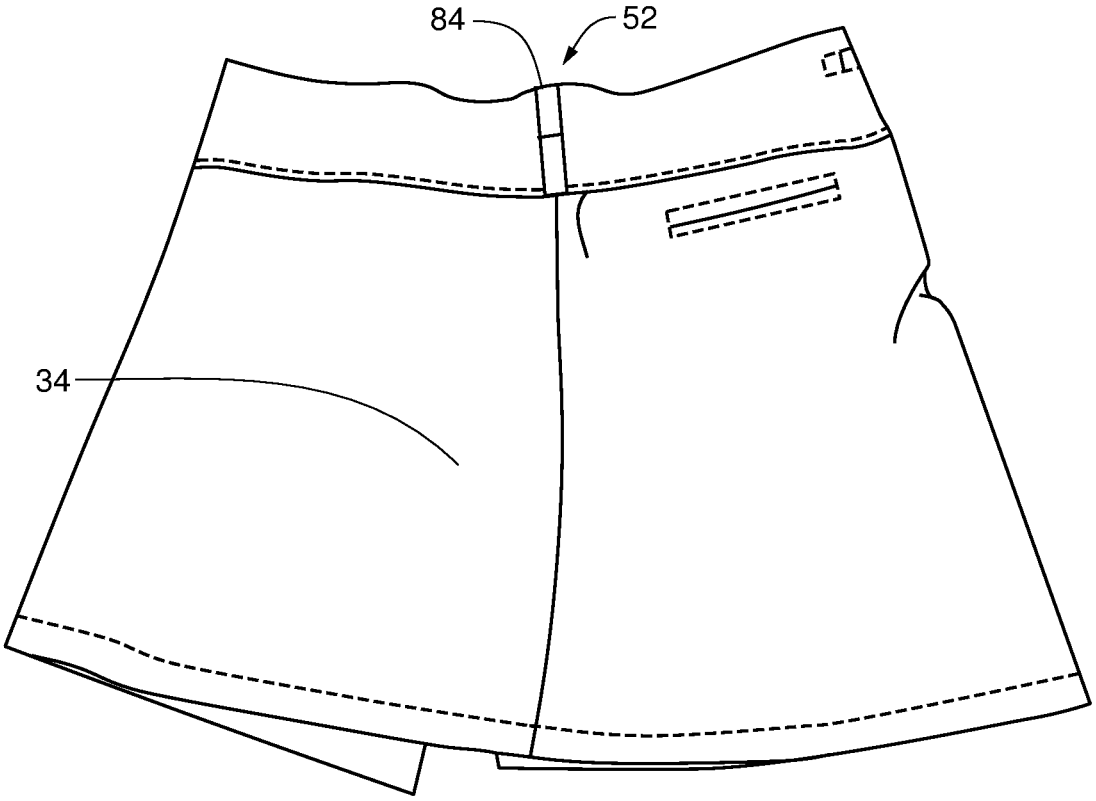
FIG. 7 is a right side view of an embodiment of the athletic garment of FIG. 1A.

Referring to FIGS. 7 and 8, in embodiments, the waistband 76 of the athletic garment 20 is wide, which allows for various storage features. For example, embodiments of the garment 20 may include a zippered pocket 82 in the waistband 76 on the rear side 28 of the garment 20. Optionally or additionally, the zippered pocket 82 may be in the waistband 76 on the front side 26 of the garment 20.

In additional embodiments, the waistband 76 may include at least one elasticized holder 84 in the form of a vertically aligned elasticized loop attached at its ends to the waistband 76, which can be used to elastically hold in place food or drink packs, or to hang key chains or other items from.

Still again to FIG. 8, for additional storage, the athletic garment 20 may also include one or more pockets, preferably one or more back pockets 86.

An additional feature in embodiments of the athletic garment 20 of the disclosure is a vertical slit in the skirt 32 to ensure that the wearer's mobility is not restricted in any way. As best shown in FIG. 6B, with the dual-position panel 22 in the first position 40, a vertical slit 88 is formed between the vertical edge portion 64 of the dual-position panel 22 and the vertical edge 56 of the second end portion 48 of the attached portion 34 of the skirt 32.

In further embodiments, referring to FIG. 6A, with the dual-position panel 22 in the second position 42, a vertical slit 90 is formed between each of a portion of the vertical edge 56 of the second end portion 48 and a vertical edge portion 64 of the dual-position panel 22 that extends vertically below the concealable decoration layer 44.

In additional embodiments, the concealable decoration layer 44 extends less than two-thirds of a length of the skirt 32, i.e., less than two-thirds of the length of the vertical edge 56, so that a slit length of the vertical slit 90 is at least one-third the length of the skirt 32.

While the invention has been particularly shown and described with reference to specific embodiments, it should be apparent to those skilled in the art that the foregoing is illustrative only and not limiting, having been presented by way of example only. Various changes in form and detail may be made therein without departing from the spirit and scope of the invention. Therefore, numerous other embodiments are contemplated as falling within the scope of the present invention as defined by the accompanying claims and equivalents thereto.

What is claimed is:

1. An athletic garment comprising:

a body-fitting portion;

a skirt draped over said body-fitting portion, and a waistband, said skirt including an attached portion fixedly attached to said body-fitting portion along said waistband, and a dual-position panel forming a detachably connected portion of said skirt, said dual-position panel being repositionable by a wearer between a first position and a second position, said detachably connected portion of said skirt configured to be attached to said athletic garment for wearing with said dual-position panel in either said first position or said second position;

wherein said attached portion of said skirt covers a rear side of said athletic garment and a portion of a front side of said athletic garment, said attached portion extending from a first end portion positioned on said front side around said rear side and terminating at a second end portion located along one of a left and right side of said athletic garment, and wherein said detachably connected portion forming said dual-position panel is positioned on said front side of said athletic garment adjacent said attached portion of said skirt; and a concealable decoration layer fixedly attached to said body-fitting portion, said concealable decoration layer and said dual-position panel being located on said front side of said athletic garment between said second end portion and said first end portion and adjacent to said attached portion of said skirt, such that said dual-position panel detachably connected in said first position overlays and substantially conceals said concealable decoration layer, and wherein said concealable decoration layer overlays at least a portion of said dual-position panel in said second position, said dual-position panel extending from said first end portion of said attached portion of said skirt to, and being detachably connected along, said one of the left and right side of said athletic garment for wearing in said first position or said second position.

2. The athletic garment of claim 1, wherein said dual-position panel is detachably connected in said first position to one of said second end portion, said concealable decoration layer, and a connecting portion between said second end portion and said concealable decoration layer and said dual-position panel is detachably connected in said second position to said body-fitting portion.

3. The athletic garment of claim 2, wherein an inner layer of said dual-position panel includes a connecting element fixedly attached thereto, said connecting element being positioned along an upper portion of a vertical edge portion of said dual-position panel, said vertical edge portion being positioned over said concealable decoration layer in said first position and under said concealable decoration layer in said second position and connected for wearing via said connecting element along said one of the left and right side of said athletic garment.

4. The athletic garment of claim 3, wherein said one of said second end portion, said concealable decoration layer, and said connecting portion includes a paired connecting element, said dual-position panel being detachably connected in said first position to said one of said second end portion, said concealable decoration layer, and said connecting portion via said connecting element and said paired connecting element.

5. The athletic garment of claim 3, wherein said body-fitting portion includes a paired connecting element, said dual-position panel being detachably connected in said second position to said body-fitting portion via said connecting element and said paired connecting element.

6. The athletic garment of claim 3, wherein one of said second end portion, said concealable decoration layer, and a connecting portion between said second end portion and said concealable decoration layer includes a first paired connecting element, said dual-position panel being detachably connected in said first position via said connecting element on said dual-position panel and said first paired connecting element on said one of said second end portion, said concealable decoration layer, and said connecting portion, and wherein said body-fitting portion includes a second paired connecting element, said dual-position panel being detachably connected in said second position to said body-fitting portion via said connecting element on said dual-position panel and said second paired connecting element.

7. The athletic garment of claim 1, wherein said concealable decoration layer includes at least one attaching element fixed on said concealable decoration layer.

8. The athletic garment of claim 7, further comprising at least one decorative item removably attached via said at least one attaching element to said concealable decorative layer in said second position.

9. The athletic garment of claim 6, wherein said connecting element on said dual-position panel is one portion of a snap device and each of said first paired connecting element and said second paired element is a second portion of said snap device.

10. The athletic garment of claim 1, wherein said body-fitting portion includes one of shorts and panties.

11. The athletic garment of claim 1, further comprising at least one back pocket.

12. The athletic garment of claim 1, wherein said concealable decoration layer has an unattached arcuate edge.

13. The athletic garment of claim 2, wherein a vertical edge portion of said dual-position panel in said first position forms a first side of a vertical slit in said skirt, and wherein a vertical edge of said second end portion forms a second side of said vertical slit.

14. The athletic garment of claim 2, wherein in said second position a vertical slit is formed between each of a portion of a vertical edge of said second end portion and a vertical edge portion of said dual-position panel that extends vertically below said concealable decoration layer.

15. The athletic garment of claim 2, wherein a vertical edge of said second end portion coincides with a side seam of said skirt, said side seam fixedly attaching said second end portion to said concealable decoration layer.

16. The athletic garment of claim 1, wherein an upper edge portion of said concealable decoration layer is fixedly attached to both said body-fitting portion and to said waistband.

17. The athletic garment of claim 16, further comprising a zippered pocket in one of a front and rear of said waistband, and at least one elasticized holder including a vertically aligned elasticized loop attached at its ends to said waistband.

18. The athletic garment of claim 16, wherein an upper edge of said dual-position panel extends across 15% to 40% of a width of said waistband.

19. The athletic garment of claim 16, wherein an upper edge of said dual-position panel extends across 25% of a width of said waistband.

* * * * *